US007354324B1

(12) United States Patent
Jaszewski et al.

(10) Patent No.: US 7,354,324 B1
(45) Date of Patent: Apr. 8, 2008

(54) METHOD AND APPARATUS FOR ASSEMBLING A MARINE PROPULSION SYSTEM IN A MARINE VESSEL

(75) Inventors: Wayne M. Jaszewski, Jackson, WI (US); George E. Phillips, Oshkosh, WI (US); Richard A. Davis, Mequon, WI (US); Tom Yerby, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/481,133

(22) Filed: Jul. 6, 2006

(51) Int. Cl.
*B63H 1/125* (2006.01)

(52) U.S. Cl. ..... 440/57

(58) Field of Classification Search ..... 440/57, 440/11, 112, 111
See application file for complete search history.

(56) References Cited

U.S. PATENT DOCUMENTS 3,128,741 A * 4/1964 Benjamen ..... 440/112
3,653,270 A 4/1972 Bergstedt ..... 74/89.15
3,669,057 A * 6/1972 Shimanckas ..... 440/112
4,289,488 A 9/1981 Weronke et al. ..... 440/57
4,872,531 A 10/1989 Meisenburg et al. ..... 184/6.4
4,940,434 A 7/1990 Kiesling ..... 440/57
5,466,178 A 11/1995 Inman et al. ..... 440/61
6,287,159 B1 9/2001 Polakowski et al. ..... 440/52
6,454,620 B1 9/2002 Theisen et al. ..... 440/61

* cited by examiner

*Primary Examiner*—Sherman D Basinger
(74) *Attorney, Agent, or Firm*—William D. Lanyi

(57) ABSTRACT

A marine propulsion system is configured to be preassembled prior to the attachment of a marine engine to the marine vessel. In other words, the marine engine is attached to a transom plate, a gimbal ring, and a bell housing prior to insertion of the engine into the marine vessel. The subassembly is then moved rearwardly to cause the bell housing, gimbal ring, and portion of the transom, bracket to pass through a preformed opening in the transom. Subsequently, a transom ring is attached to the transom bracket to affix the subassembly to the transom. Then a marine drive unit is attached to the bell housing.

11 Claims, 9 Drawing Sheets

METHOD AND APPARATUS FOR ASSEMBLING A MARINE PROPULSION SYSTEM IN A MARINE VESSEL

BACKGROUND OF THE INVENTION

1. Field of the Invention

The present invention relates generally to a method and apparatus for assembling of a marine propulsion system and, more particularly, to a method and apparatus for preassembling a subassembly and then attaching the subassembly to the marine vessel.

2. Description of the Related Art

Many types of marine propulsion devices are well known to those skilled in the art. One particular type of marine propulsion system is a sterndrive system which comprises a driveshaft that extends through the transom of a marine vessel. The driveshaft connects an internal combustion engine with a drive unit. The internal combustion engine is located within the bilge of a marine vessel and the drive unit is located behind a transom of the vessel. The torque transferring shaft extends through an opening that is formed through the structure of a transom of the marine vessel.

U.S. Pat. No. 3,653,270, which issued to Bergstedt on Apr. 4, 1972, describes a tilting and trimming arrangement for a tiltable outboard propeller housing for a boat. A linkage system couples a jack screw mechanism operated by a reversible electric motor to the tiltable propeller housing. The jack screw mechanism is self-aligning by being mounted by a ball and socket and includes a worm drive between the motor and a rotatable nut which screws a threadable rod up and down through the nut. The nut is engaged in operative position by spring loaded detents which yield to release the nut and thereby permit the propeller housing to kick up upon meeting an obstruction.

U.S. Pat. No. 4,289,488, which issued to Weronke et al. on Sep. 15, 1981, discloses a sterndrive gimbal arrangement. In a sterndrive for a watercraft, of the type using a gimbal ring to support the external propulsion unit, a gimbal ring is provided with an upper vertical square bore, a slot across the bore, and clamping bolts to provide full engagement with the square sides of a steering swivel shaft.

U.S. Pat. No. 4,872,531, which issued to Meisenburg et al. on Oct. 10, 1989, discloses a marine sterndrive with through-housings lubrication system. The unit includes an assemblage of a propeller-carrying driveshaft housing, a bell housing and gimbal housing. Mating flow through passages are disposed in the driveshaft housing and bell housing, and a dual control valve system joins the passages at their juncture. The valve system is arranged to be open when the two housings are assembled, but closes automatically when the housings are disassembled to retain lubricant in the separate housing assemblies when the latter are separated for servicing.

U.S. Pat. No. 4,940,434, which issued to Kiesling on Jul. 10, 1990, discloses a marine propulsion unit universal drive assembly with through-bellows exhaust. The device is provided wherein a pair of generally telescoped bellows surround the universal joint and provide an exhaust passage therebetween which communicates between the inboard engine and the sterndrive unit. The inner bellows rotates with the universal joint while the outer bellows is stationary. The bellows are preferably of helical or spiral configuration and the rotating inner bellows forms an exhaust pump.

U.S. Pat. No. 5,466,178, which issued to Inman et al. on Nov. 14, 1995, describes a load relieving external steering system for marine outdrive units. The system comprises a first hydraulic steering ram having a piston partially disposed within a housing, wherein the piston is attached to one side of an outdrive unit and the housing is attached to an adjacent portion of a transom. A second hydraulic steering ram has a piston partially disposed within a housing, wherein the piston of the second steering ram is attached to an opposite side of the outdrive unit and the housing of the second steering ram is attached to an adjacent portion of the transom.

U.S. Pat. No. 6,287,159, which issued to Polakowski et al. on Sep. 11, 2001, discloses a marine propulsion device with a compliant isolation mounting system. A support apparatus for a marine propulsion system in a marine vessel is provided with a compliant member that is attachable to the transom of a marine vessel. In certain applications, the compliant member is directly attached to an intermediate plate and to an external frame member that is, in turn, attached directly to the transom of the marine vessel. The intermediate plate is attached directly to components of the marine propulsion system to provide support for the marine propulsion system relative to the transom, but while maintaining non-contact association between the marine propulsion system and the transom.

U.S. Pat. No. 6,454,620, which issued to Theisen et al. on Sep. 24, 2002, discloses an integrated external hydraulic trimming and steering system for an extended sterndrive transom assembly. A marine propulsion system is provided with a drive unit that is attachable to a transom of a marine vessel and provided with steering cylinder assemblies and trimming cylinder assemblies which are connected to a common location on a structure member, such as a gimbal ring. This arrangement improves the geometric relationship between the steering and trimming functions. In addition, the hydraulic steering system is provided with pressure relief valves that are located at the transom of the marine vessel in order to shorten the distance of the hydraulic conduits extending between the pressure relief valves and the steering cylinders.

The patents described above are hereby expressly incorporated by reference in the description of the present invention.

SUMMARY OF THE INVENTION

A method for assembling a marine propulsion system, according to a preferred embodiment of the present invention, comprises the steps of providing an engine and attaching a transom bracket to the engine. It also comprises the steps of moving the engine to a position in front of a transom of the marine vessel, after the transom bracket is attached to the engine, with the transom bracket extending from the engine in the direction toward the transom and subsequently moving the engine rearwardly toward the transom to cause at least a portion of the transom bracket to extend through an opening formed through the transom. It further comprises the step of attaching a gimbal ring to the transom bracket prior to moving the engine toward the transom to cause at least said portion of the transom bracket to extend through the opening formed through the transom.

In addition, a preferred embodiment of the present invention comprises the step of inserting the gimbal ring through the opening after the gimbal ring is attached to the transom bracket. It also comprises the step of attaching a bell housing to the gimbal ring prior to moving the engine toward the transom to cause at least the portion of the transom bracket to extend through the opening formed through the transom. In addition, a preferred embodiment of the present invention comprises the step of inserting the bell housing through the opening after the bell housing is attached to the gimbal ring.

In a preferred embodiment of the present invention, it further comprises the step of attaching a marine drive unit to the bell housing after the bell housing is inserted through the opening in the transom. It also comprises the step of connecting a driveshaft of the drive unit in torque transmitting association with the crankshaft of the engine.

In a preferred embodiment of the present invention, it further comprises the step of attaching a transom ring to the transom bracket with the transom disposed between the transom ring and at least a portion of the transom bracket. The transom bracket comprises a sealing surface which is configured to be disposed in contact with a surface of the transom which faces the engine. A preferred embodiment of the present invention also comprises the step of attaching the engine to the marine vessel with the crankshaft disposed for rotation about a generally horizontal axis.

A marine propulsion system, made in accordance with a preferred embodiment of the present invention, comprises an engine, a transom bracket which is configured to be attached to the engine before the engine is disposed within a marine vessel, a gimbal ring which is configured to be attached to the transom bracket before the engine is disposed within the marine vessel, a transom ring which is configured to be attached to the transom bracket after the gimbal ring is extended through an opening in the transom of the marine vessel, a drive unit which is configured to be attached to the gimbal ring, and a driveshaft of the drive unit which is connectable in torque transmitting association, through the opening in the transom, with a crankshaft of the engine. A transom bracket comprises a sealing surface which is configured to be disposed in contact with the surface of the transom which faces the engine and the engine is configured to be attached to the marine vessel with the crankshaft disposed for rotation about a generally horizontal axis.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
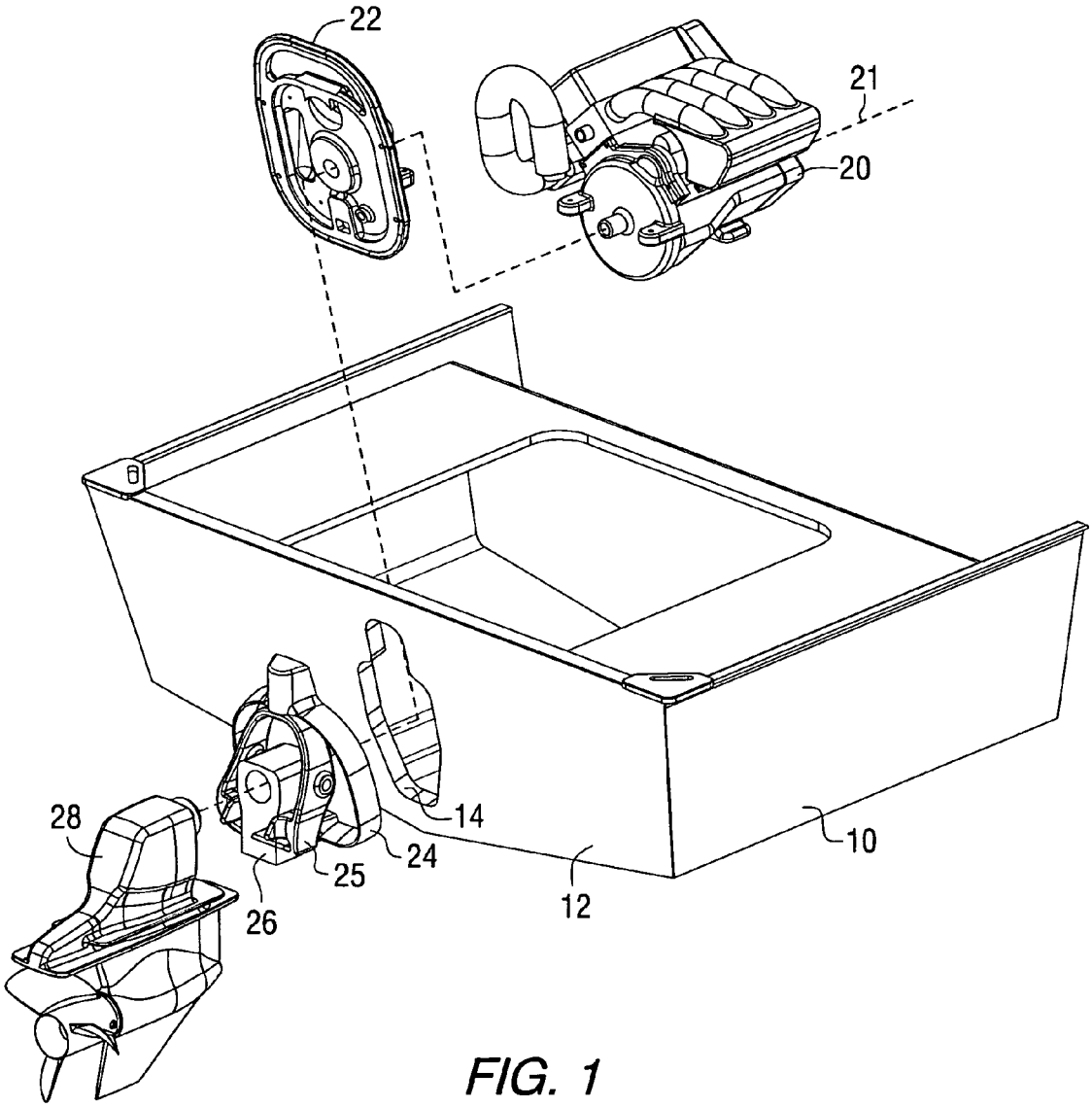
FIG. 1 PRIOR ART
FIG. 1 is an exploded isometric view of a known type of marine propulsion system.

Throughout the description of the preferred embodiment of the present invention, like components will be identified by like reference numerals.

In order to fully appreciate the advantages of the present invention, it is helpful to first understand the method by which marine propulsion systems are currently assembled in a marine vessel.

FIG. 1 is an exploded isometric representation of components of a known type of marine propulsion system. A marine vessel 10 is shown with a transom 12 having a hole 14 formed through it. Also shown in FIG. 1 is an engine 20, a transom bracket 22, a transom ring 24, a gimbal ring 25, a bell housing 26, and a marine drive unit 28. As is well known to those skilled in the art, the assembly procedure attaches the transom bracket 22 to an inside surface of the transom 12 and the transom ring 24 to an outside surface of the transom 12. The transom bracket 22 and the transom ring 24 are attached together with the transom 12 therebetween. The gimbal ring 25 is pivotally attached to the transom ring 24 and the bell housing 26 is pivotally attached to the gimbal ring 25. The engine 20 is shown with its crankshaft axis 21.

Figure 2:
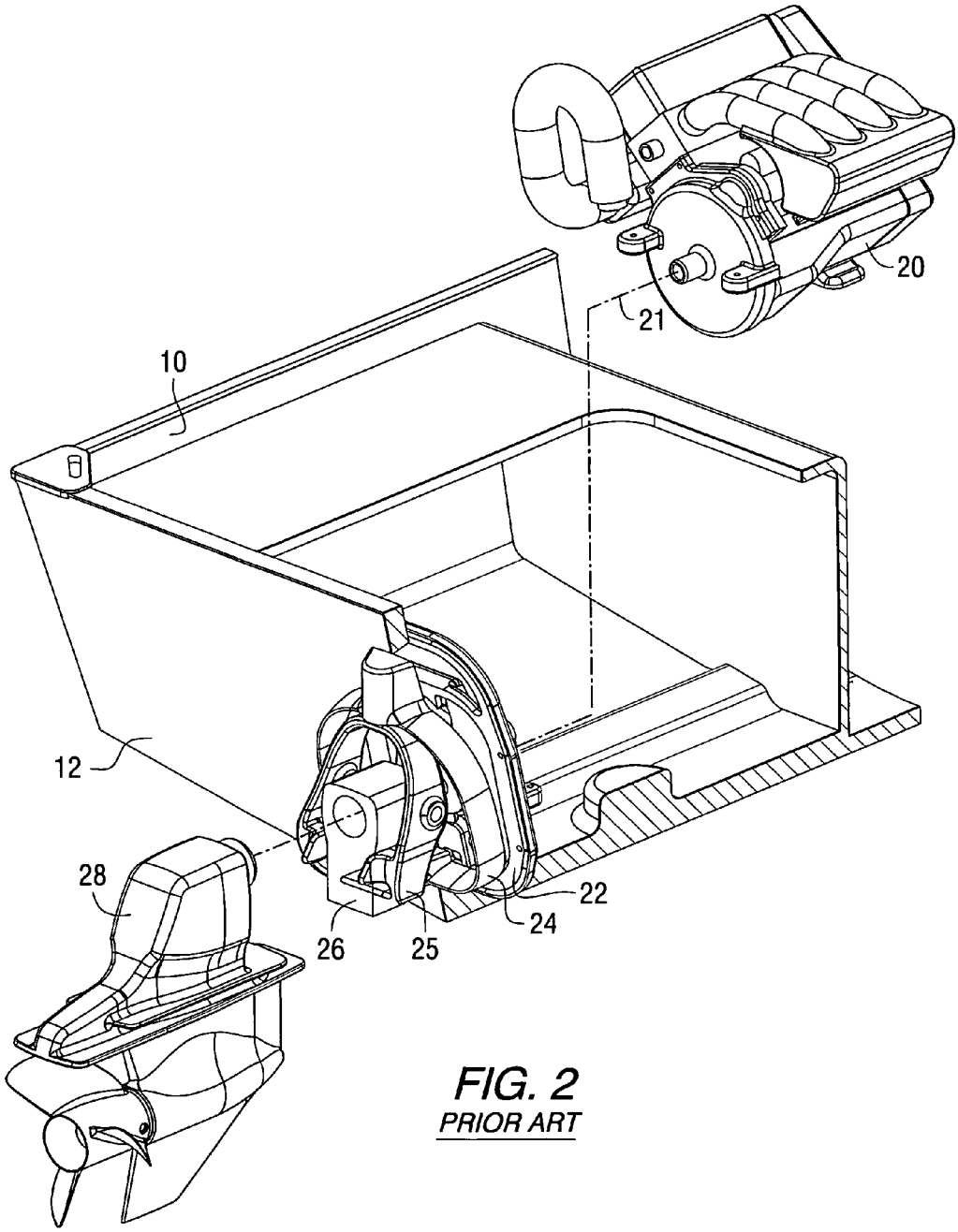
FIG. 2 PRIOR ART
FIG. 2 shows the components of FIG. 1 partially attached to a transom of a marine vessel.

FIG. 2 is a sectioned isometric representation of the marine vessel 10 after the transom bracket 22 and the transom ring 24 are attached together with the transom 12 therebetween. The condition represented in FIG. 2 is before the engine 20 is placed in the bilge of the marine vessel 10, with its crankshaft axis 21 being generally horizontal, and the marine drive unit 28 is attached to the bell housing 26. As is generally known to those skilled in the art, the gimbal ring 25 is pivotally attached to the transom ring 24 for rotation about a generally vertical steering axis. The bell housing 26 is pivotally attached to the gimbal ring 25 for rotation about a generally horizontal trim axis.

Figure 3:
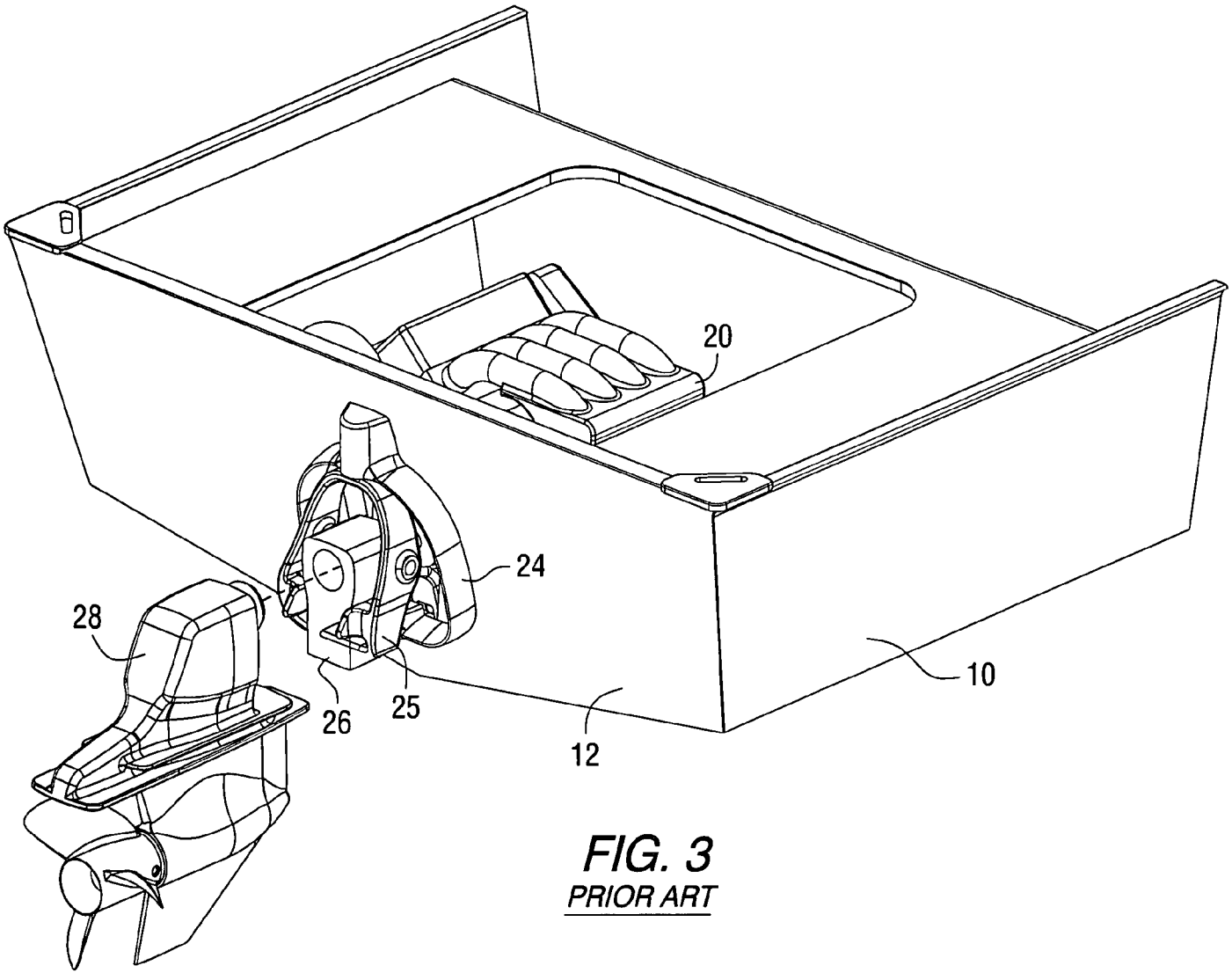
FIG. 3 PRIOR ART
FIG. 3 shows the engine attached to the marine vessel.

FIG. 3 illustrates the next step in the known method of assembling a sterndrive system in a marine vessel 10. The engine 20 is lowered into the bilge of the marine vessel 10 and attached to the transom bracket 22 which is not shown in FIG. 3, but is illustrated and described in FIGS. 1 and 2. This attachment between the engine 20 and the transom bracket 22 is accomplished prior to attaching the marine drive unit 28 to the bell housing 26.

Figure 4:
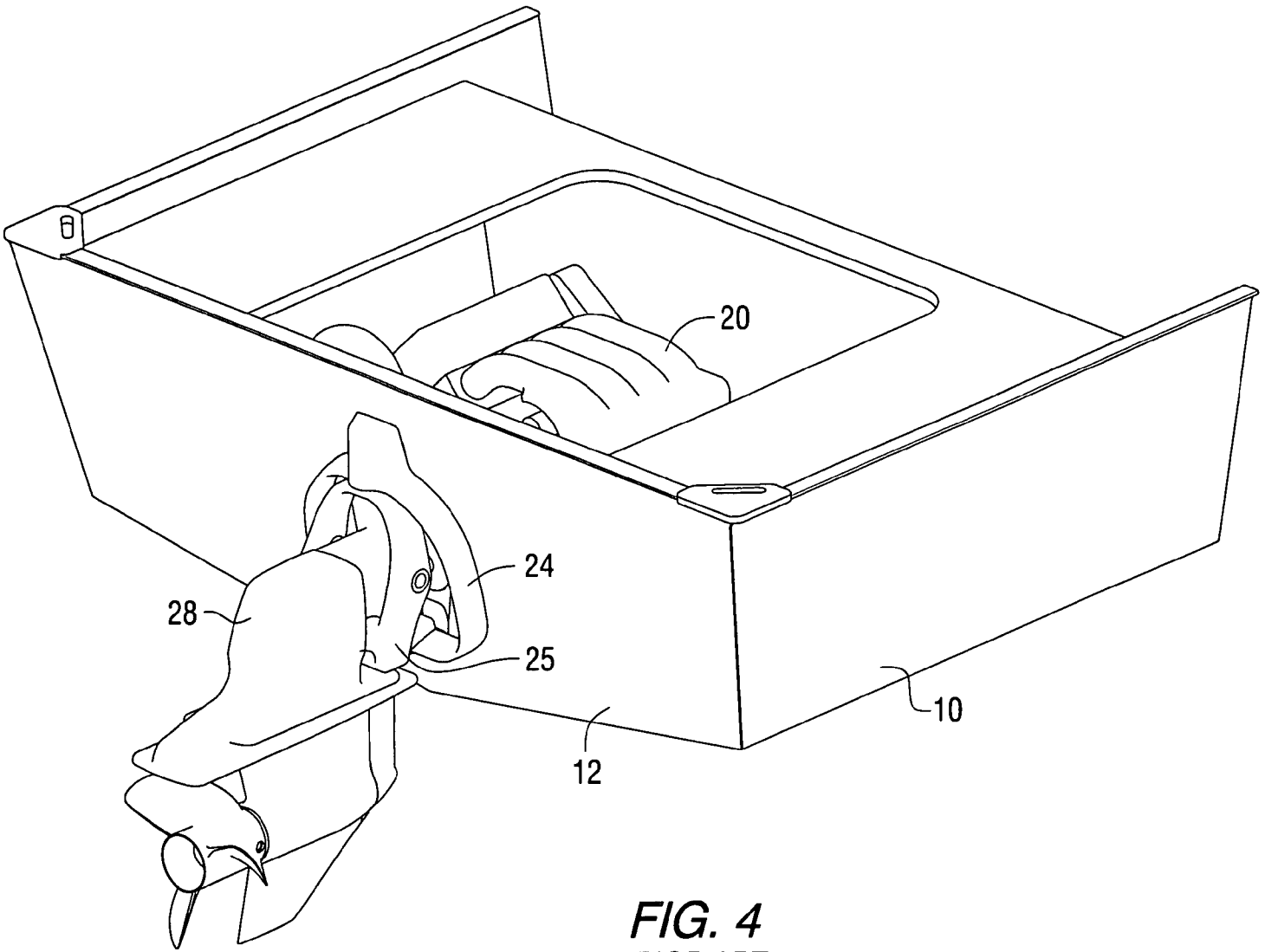
FIG. 4 PRIOR ART
FIG. 4 is a completed assembly according to a process known to those skilled in the art.

FIG. 4 shows the marine vessel and its marine propulsion system after the marine drive unit 28 is attached to the bell housing 26 which is not visible in FIG. 4, but which is described above in conjunction with FIGS. 1-3.

With continued reference to FIGS. 1-4, the assembly procedure can be cumbersome and inefficient when the assembly steps have to be performed in the sequence described above. This assembly sequence can also result in a difficult problem of proper alignment of the various components with respect to the engine 20. It would therefore be significantly beneficial if an improved assembly method and order of operations could be provided.

Figure 5:
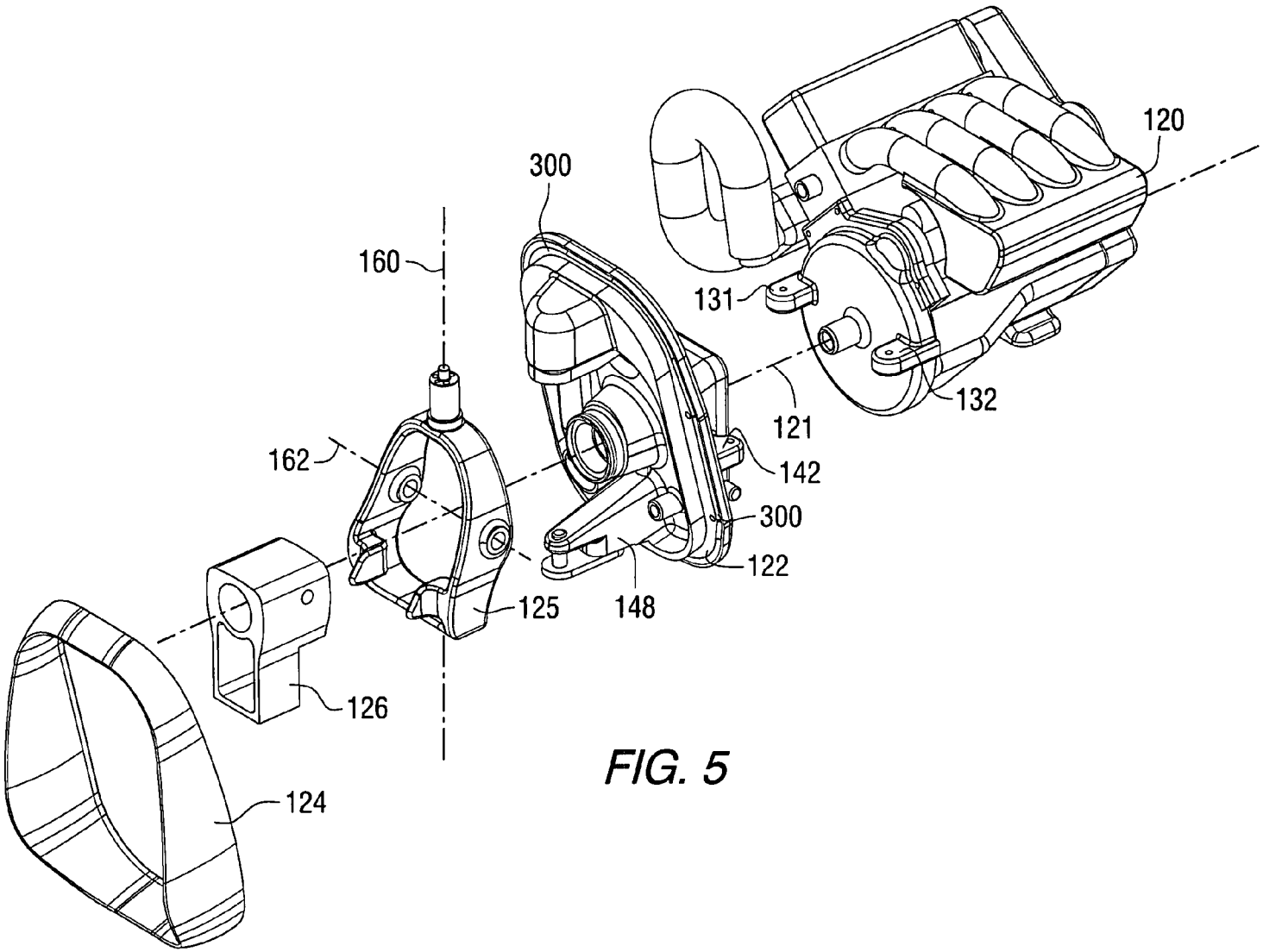
FIG. 5 is an isometric exploded view of the components of the present invention.

FIG. 5 is an exploded isometric view of the components used in conjunction with a preferred embodiment of the present invention. An engine 120 is configured to be attached to a transom bracket 122 prior to the assembly of the engine 120 into the marine vessel. To facilitate this configuration, pads 131 and 132 are provided as part of the engine 120. In addition, the transom bracket 122 is provided with associated pads. As an example, pad 142 is configured to facilitate the attachment of the transom bracket 122 to pad 132 of the engine 120. A similar pad, which is not visible in FIG. 5, is configured to be attached to pad 131 of the engine 120. With the transom bracket 122 rigidly attached to the engine 120, the subassembly can be assembled into a marine vessel 10 with a portion of the transom bracket 122 extending through an opening in the transom. However, a particularly preferred embodiment of the present invention attaches the gimbal ring 125 to the transom bracket 122 prior to this assembly step of moving the engine 120 into the bilge of the marine vessel 10 and attaching it thereto. Although the subassembly, comprising the engine 120, the transom bracket 122, and the gimbal ring 125, can then be assembled into the marine vessel 10 with the gimbal ring 125 and portion 148 of the transom bracket 122 extending through a hole in the transom of the marine vessel, a particularly preferred embodiment of the present invention first attaches the bell housing 126 to the gimbal ring 125. In FIG. 5, the generally vertical axis 160 is illustrated to show the rotatable relationship between the gimbal ring 125 and the transom bracket 122 and the horizontal axis 162 is illustrated to show the rotatable relationship between the bell housing 126 and the gimbal ring 125. The bell housing 126 can pivot about the horizontal axis 162 and the gimbal ring 124 can pivot about the generally vertical axis 160. The transom ring 124 is shown relative to the other components in FIG. 5.

Figure 6:
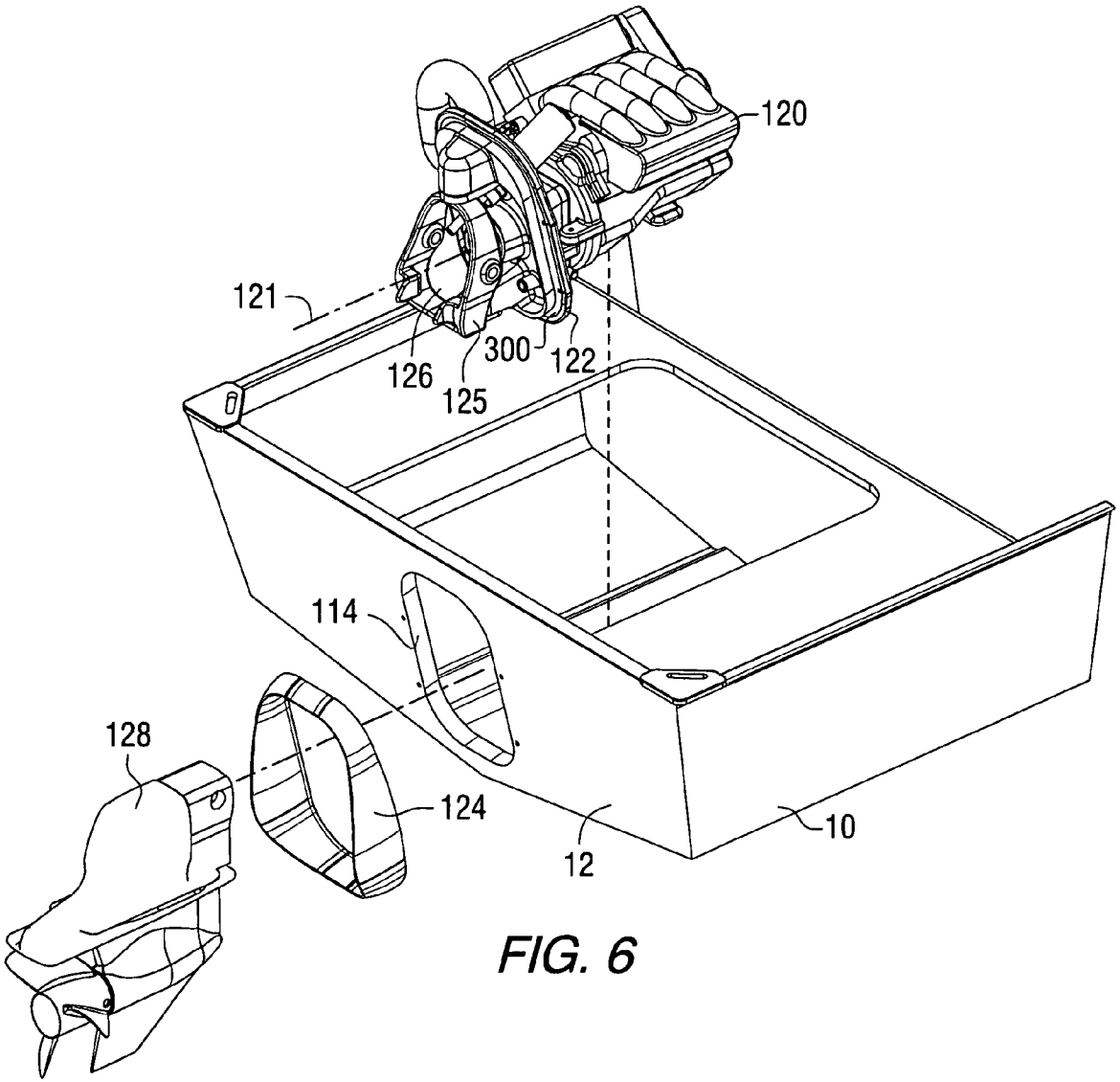
FIG. 6 shows the components of the present invention after a subassembly has been created and prior to assembly in a marine vessel.

FIG. 6 shows the engine 120 with the transom bracket 122, the gimbal ring 125, and the bell housing 126 attached to it. This subassembly is assembled prior to moving the engine 120 into the bilge of the marine vessel 10.

With continued reference to FIGS. 5 and 6, the engine 120, the transom bracket 122, the gimbal ring 125, and the bell housing 126, as a preassembled subassembly, are then moved into the bilge of the marine vessel 10 and moved in a rearward direction to cause a portion of the transom bracket 122, the gimbal ring 125, and the bell housing 126 to extend through the opening 114. After this is accomplished, the transom ring 124 is moved in a forward direction and attached to the transom plate 122 by a plurality of bolts that extend either through portions of the transom 12 or through the opening 114. After this process is complete, the marine drive unit 128 is moved toward the transom 12 and attached to the bell housing 126.

Figure 7:
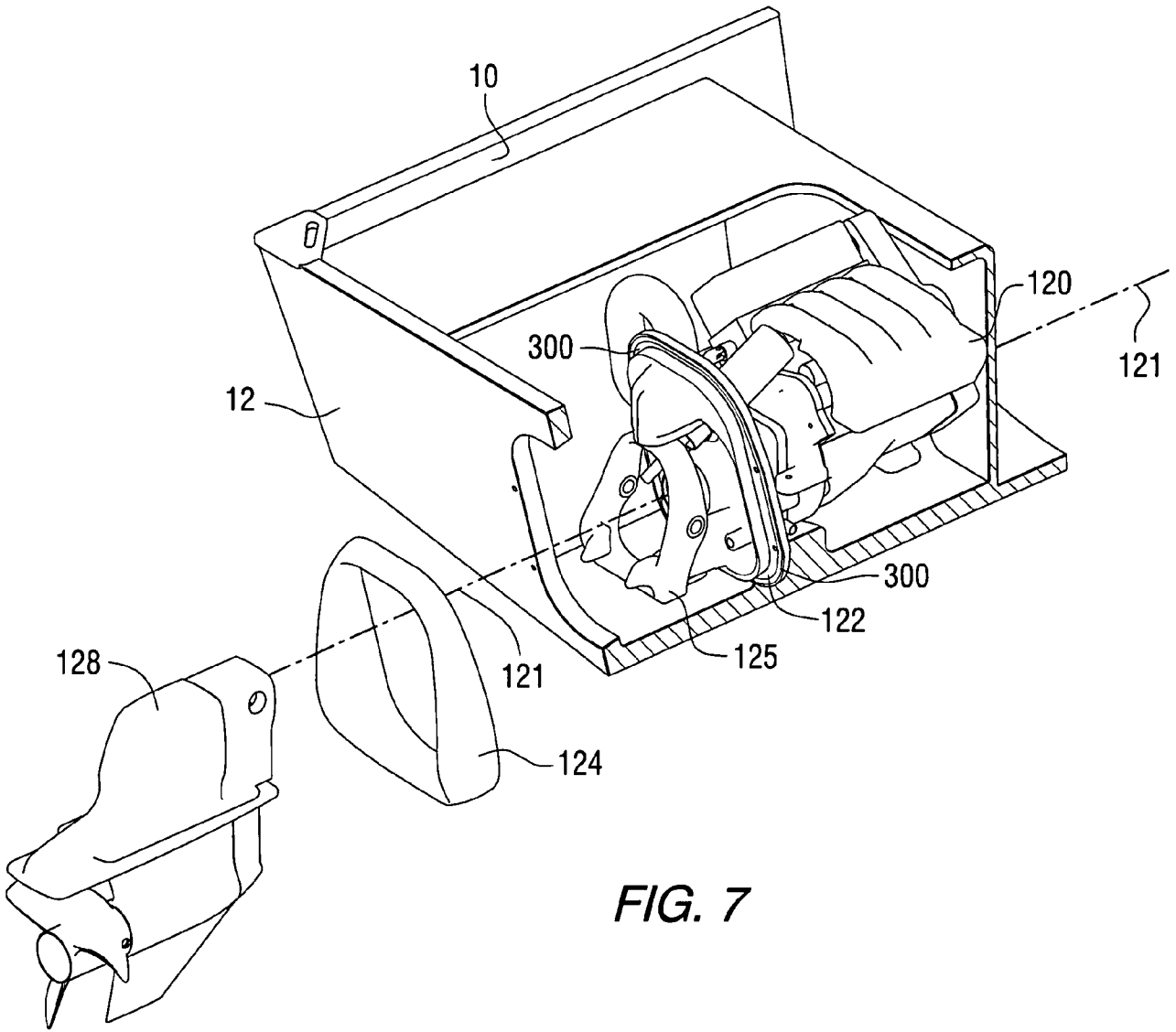
FIG. 7 indicates a later step in the assembly method of the present invention, in comparison to FIG. 6.

FIG. 7 is a section view of the marine vessel 10 with the engine 120, the transom bracket 122, the gimbal ring 125, and bell housing prior to movement of this subassembly in a rearward direction to cause the gimbal ring 125, bell housing, and a portion of the transom bracket 122 to move through the opening 114 formed in the transom 12. After this is accomplished, the transom ring 124 is attached to the transom 12 and transom bracket 122 as described above. Then, the marine drive unit 128 is attached to the bell housing. One important advantage of the present invention is that the subassembly, comprising the engine 120, transom bracket 122, gimbal ring 125, and bell housing 126, can be preassembled to form a subassembly. This facilitates the proper alignment and attachment of these components together prior to the movement of this subassembly into the marine vessel 10. This also simplifies the effort required by the boat builder because this subassembly can be preassembled by the manufacturer of the marine propulsion system. The boat builder need only place the subassembly into the marine vessel, as described above, attached the transom ring 124, and then attach the marine drive unit 128 to the bell housing 126. During this final assembly, a driveshaft of the marine drive unit 128 is connected in torque transmitting association with a crankshaft of the engine 120 for synchronous rotation about a generally horizontal axis 121.

Figure 8:
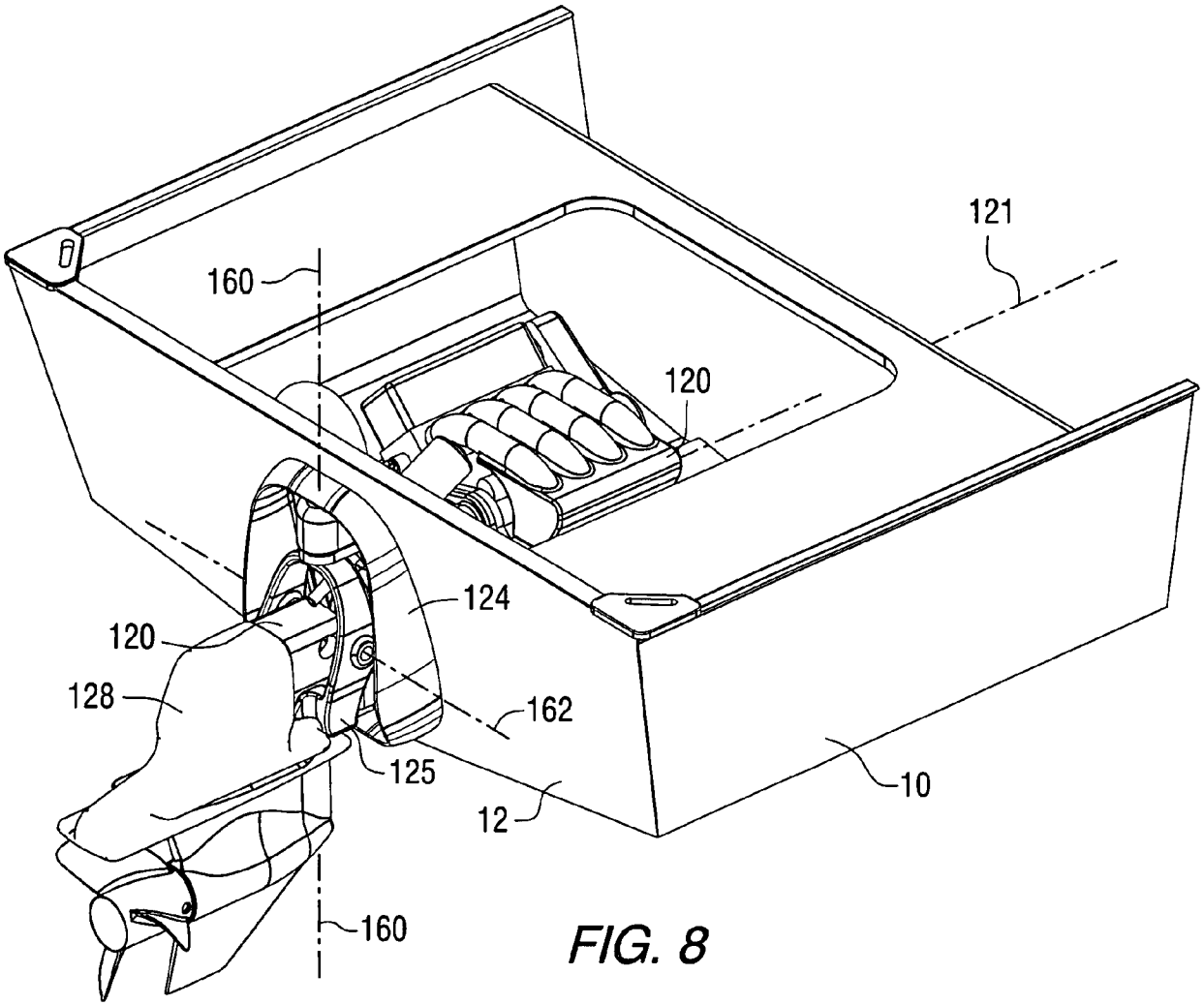
FIG. 8 shows a completely assembled marine propulsion system according to the concepts of the present invention.

FIG. 8 is an isometric view of the assembled marine propulsion system. The engine 120 is attached to the marine vessel 10 with its crankshaft aligned for rotation about a generally horizontal axis 121. The transom ring 124 is attached to the transom bracket 122 (not visible in FIG. 8). The gimbal ring 125 is rotatably attached to the transom ring 124 for rotation about a generally vertical steering axis 160 and the bell housing 126 is attached to the transom ring 128 for rotation about a generally horizontal trim axis 162. Also shown in FIG. 8 is the marine drive unit 128 which is attached to the bell housing.

Figure 9A:
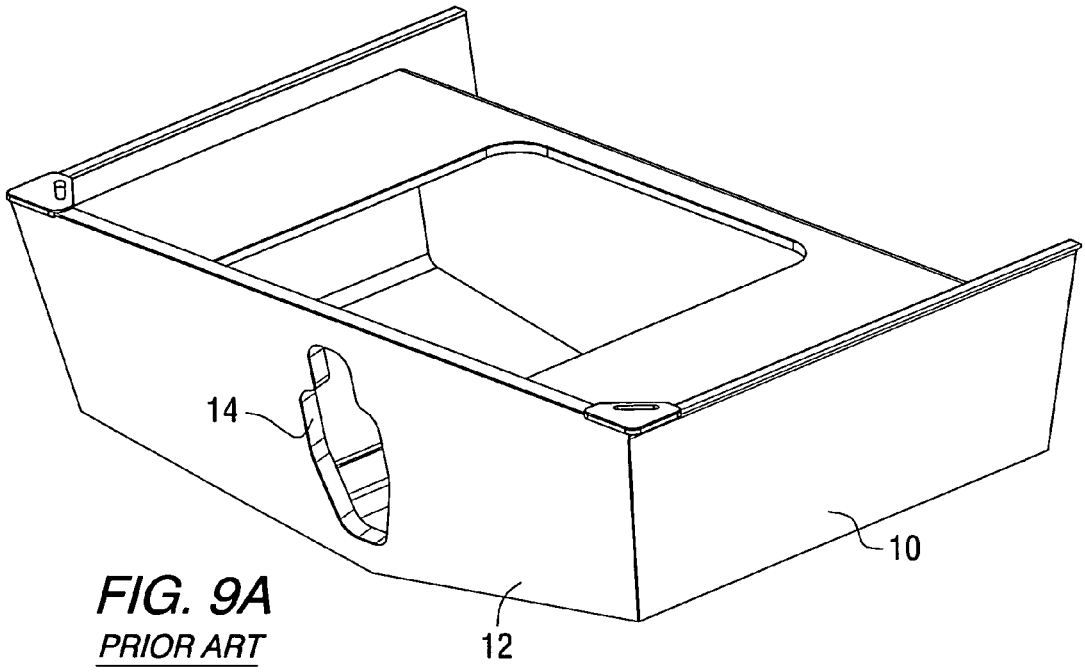
FIG. 9A PRIOR ART
FIGS. 9A and 9B compare the openings in a transom according to the prior art and according to the preferred embodiment of the present invention.
Figure 9B:
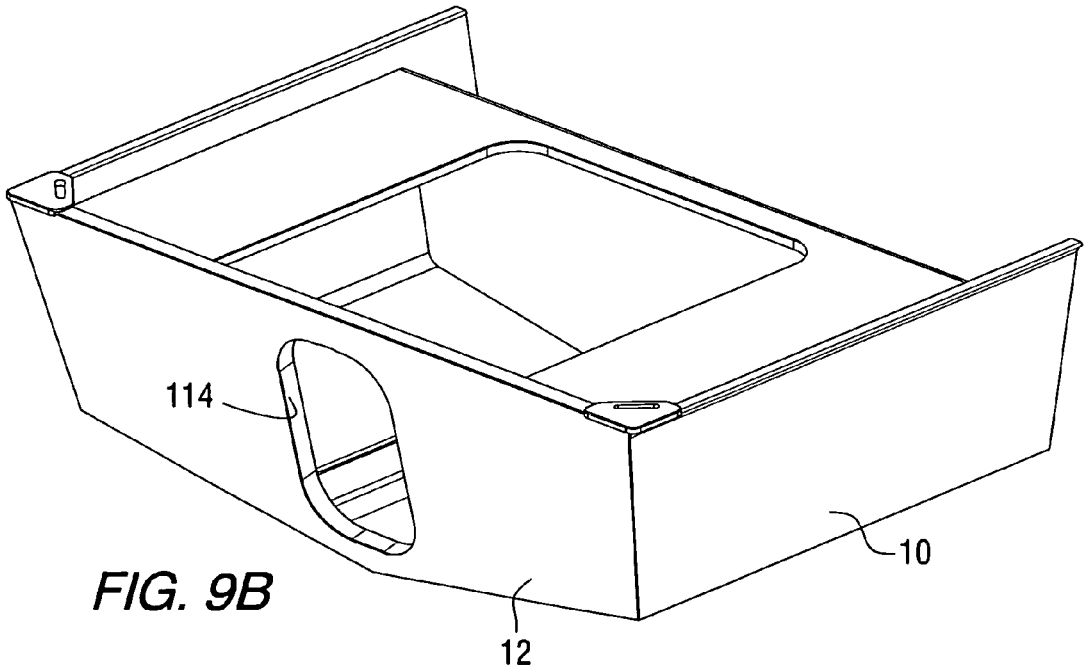

FIGS. 9A and 9B show the transom opening configuration in a known marine vessel 10 and in a marine vessel made according to the concept of a preferred embodiment of the present invention, respectively. As can be seen, the known opening 14 is shaped to conform with the assembly of the transom ring 24, gimbal ring 25, and bell housing 26 in a direction from behind the transom 12 and attachment to a transom bracket 22 which has been prelocated on an inside surface of the transom 12, as described above in conjunction with FIGS. 1-3. The opening 114 used in conjunction with the present invention, on the other hand, is shaped to facilitate the assembly of a preassembled subassembly, as described above in conjunction with FIG. 6. The periphery of the opening 114 is configured and sized to allow the bell housing 126, gimbal ring 125, and a portion of the transom bracket 122 to pass through the opening 114. In addition, the periphery of the opening 114 is sized to be smaller than the outer edge 300 of the transom bracket 122. When the preassembled engine subassembly is moved into the transom of the marine vessel 10 and then in a rearward direction to cause the gimbal ring 125 and bell housing 126 to pass through the opening 114, the outer edge 300 will be moved against an inner surface of the transom 12 to facilitate attachment of the transom bracket 122 to the transom ring 124 with the transom 12 therebetween and to seal the interface between the rearward surface of the transom bracket 122, proximate the edge 300 (illustrated in FIGS. 5, 6 and 7), to the transom ring 124.

The primary advantage of the present invention is that it allows preassembly of the engine, transom bracket, transom ring, and bell housing prior to assembly of this subassembly into a marine vessel. As a result, the alignment and preassembly can be accomplished by the manufacturer of the marine propulsion system as opposed to being performed by the boat builder. This has been described above in detail in conjunction with the known method (illustrated in FIGS. 1-4) and the method of the present invention (illustrated in FIGS. 5-8).

Although the present invention has been described in particular detail and illustrated to show a preferred embodiment, it should be understood that alternative embodiments are also within its scope.

We claim:

1. A method for assembling a marine propulsion system, comprising the steps of:

providing an engine;

attaching a transom bracket to said engine;

moving said engine to a position in front of a transom of said marine vessel, after said transom bracket is attached to said engine, with said transom bracket extending from said engine in a direction toward said transom;

moving said engine toward said transom to cause at least a portion of said transom bracket to extend through an opening formed through said transom;

attaching a gimbal ring to said transom bracket prior to moving said engine toward said transom to cause at least said portion of said transom bracket to extend through said opening formed through said transom;

attaching a bell housing to said gimbal ring prior to moving said engine toward said transom to cause at least portion of said transom bracket to extend through said opening formed through said transom; and inserting said bell housing through said opening after said bell housing is attached to said gimbal ring.

2. The method of claim 1, further comprising:

attaching a marine drive unit to said bell housing after said bell housing is inserted through said opening.

3. The method of claim 2, further comprising:

connecting a drive shaft of said drive unit in torque transmitting association with a crankshaft of said engine.

4. The method of claim 1, further comprising:

attaching a transom ring to said transom bracket with said transom disposed between said transom ring and at least a portion of said transom bracket.

5. The method of claim 1, wherein:

said transom bracket comprises a sealing surface which is configured to be disposed in contact with a surface of said transom which faces said engine.

6. The method of claim 1, further comprising:

attaching said engine to said marine vessel with said crankshaft disposed for rotation about a generally horizontal axis.

7. A method for assembling a marine propulsion system, comprising the steps of:

providing an engine;

attaching a transom bracket to said engine;

moving said engine to a position in front of a transom of said marine vessel, after said transom bracket is attached to said engine, with said transom bracket extending from said engine in a direction toward said transom;

moving said engine toward said transom to cause at least a portion of said transom bracket to extend through an opening formed through said transom;

attaching a gimbal ring to said transom bracket prior to moving said engine toward said transom to cause at least said portion of said transom bracket to extend through said opening formed through said transom;

attaching a bell housing to said gimbal ring prior to moving said engine toward said transom to cause at least said portion of said transom bracket to extend through said opening formed through said transom; and inserting said gimbal ring and said bell housing through said opening after said bell housing is attached to said gimbal ring.

8. The method of claim 7, further comprising:

attaching a marine drive unit to said bell housing after said bell housing is inserted through said opening.

9. The method of claim 7, further comprising:

attaching a transom ring to said transom bracket with said transom disposed between said transom ring and at least a portion of said transom bracket.

10. The method of claim 7, wherein:

said transom bracket comprises a sealing surface which is configured to be disposed in contact with a surface of said transom which faces said engine.

11. The method of claim 7, further comprising:

attaching said engine to said marine vessel with said crankshaft disposed for rotation about a generally horizontal axis.

* * * * *